US008790145B2

(12) United States Patent
Reid et al.

(10) Patent No.: US 8,790,145 B2
(45) Date of Patent: Jul. 29, 2014

(54) EMERGENCY DRIVE UNIT FOR WATER VESSEL

(75) Inventors: Charles R. Reid, Wainscott, NY (US); Mark S McNeil, Ocoee, FL (US); Theresa M Cherry, Clermont, FL (US)

(73) Assignee: Shoreline Products Inc., Sag Harbor, NY (US)

( * ) Notice: Subject to any disclaimer, the term of this patent is extended or adjusted under 35 U.S.C. 154(b) by 112 days.

(21) Appl. No.: 13/462,564

(22) Filed: May 2, 2012

(65) Prior Publication Data

US 2012/0302114 A1 Nov. 29, 2012

Related U.S. Application Data

(60) Provisional application No. 61/490,374, filed on May 26, 2011.

(51) Int. Cl.
*B63H 21/17* (2006.01)
*B63H 5/20* (2006.01)
*B63H 23/34* (2006.01)

(52) U.S. Cl.
CPC . *B63H 5/20* (2013.01); *B63H 23/34* (2013.01)
USPC ..... 440/6; 440/49; 440/53

(58) Field of Classification Search
USPC ..... 440/6, 49, 53, 75
See application file for complete search history.

(56) References Cited

U.S. PATENT DOCUMENTS 827,202 A * 7/1906 Bachman ..... 440/53
2,513,050 A * 6/1950 Pugh ..... 440/53
3,315,631 A * 4/1967 Bass ..... 440/6
3,498,253 A * 3/1970 Wood, Jr. ..... 440/6
4,637,332 A * 1/1987 Glime ..... 114/61.23
4,668,197 A * 5/1987 Proto ..... 440/54
4,678,440 A * 7/1987 Rodrigue et al. ..... 440/53
4,752,256 A * 6/1988 Dorion ..... 440/49
5,405,277 A * 4/1995 Stalker ..... 440/49
5,443,028 A * 8/1995 Keen ..... 114/248
5,904,602 A * 5/1999 Rumler et al. ..... 440/61 R
5,967,863 A * 10/1999 Marchant ..... 440/6

(Continued)

FOREIGN PATENT DOCUMENTS

AT 26681 T 5/1987
AU 2003262509 A1 6/2004

(Continued)

*Primary Examiner* — Lars A Olson
*Assistant Examiner* — Jovon Hayes
(74) *Attorney, Agent, or Firm* — Andrew S. Langsam; Pryor Cashman LLP

(57) ABSTRACT

A collapsible and disconnectible for storage yet extending for use emergency motor drive unit for a boat. A motor is secured to a hollow drive-shaft pipe segment. Another pipe segment is attached to the end of that pipe segment and has a propeller at its end. A drive shaft of the motor is coupled to the propeller by flexible tubing passing through the hollow bores of the pipe segments. A third, and possibly fourth and fifth, pipe segment(s) is(are) provided between the other two segments to extend the length of the overall device. At least one pipe segment has a vertical support post which allows the device to be selectively held in the receptacle of an anchor light receptacle, when needed. A clamp block and ball swivel allow for rotational, lengthwise, and angular movement of the pipe segments to adjust the motor and the propeller to maximize efficiency of use.

12 Claims, 11 Drawing Sheets

(56) References Cited

U.S. PATENT DOCUMENTS

| | | | | |
|---|---|---|---|---|
| 5,993,274 | A * | 11/1999 | Rising et al. | 440/53 |
| 6,234,854 | B1 * | 5/2001 | Rydzewski | 440/57 |
| 6,394,408 | B1 * | 5/2002 | Henderson et al. | 248/640 |
| 6,616,489 | B1 * | 9/2003 | Dompierre et al. | 440/49 |
| 6,682,432 | B1 * | 1/2004 | Shinozuka | 464/78 |
| 6,789,405 | B1 * | 9/2004 | Mathers | 70/14 |
| 6,866,553 | B2 * | 3/2005 | Escacena Perez | 440/63 |
| 6,984,157 | B2 * | 1/2006 | Campbell | 440/56 |
| 7,473,148 | B2 * | 1/2009 | Ichikawa et al. | 440/6 |
| 7,993,174 | B2 * | 8/2011 | Hultsch et al. | 440/75 |
| 2004/0142610 | A1 | 7/2004 | Perez | |
| 2004/0229523 | A1 | 11/2004 | Campbell | |
| 2012/0302114 | A1 * | 11/2012 | Reid et al. | 440/82 |

FOREIGN PATENT DOCUMENTS

| | | | |
|---|---|---|---|
| DE | 3463241 | D1 | 5/1987 |
| EP | 0130155 | A2 | 1/1985 |
| EP | 0130155 | A3 | 7/1985 |
| EP | 0130155 | B1 | 4/1987 |
| EP | 1422136 | A2 | 5/2004 |
| EP | 1422136 | A3 | 1/2008 |
| IT | 8348571 | | 6/1983 |
| IT | 1218335 | B | 4/1990 |
| NZ | 529768 | A | 11/2005 |

* cited by examiner

EMERGENCY DRIVE UNIT FOR WATER VESSEL

RELATED APPLICATIONS

This application claims priority from and upon earlier filed U.S. provisional patent application No. 61/490,374, filed on May 26, 2011, entitled "Emergency Marine Motor," the entirety which is incorporated by reference herein.

FIELD OF THE INVENTION

The present invention is generally related to an emergency drive unit or auxiliary motor for a small or medium size motor or sail boat. The emergency drive unit is collapsed into a compact configuration when not in use and, yet, can be quickly and easily readied for use, when the emergency arises necessitating the drive motor. A problem present in small and medium size motor boats is that an engine failure could leave the boat occupants stuck in the middle of the water without an easy way to get back to shore. Unlike a land motor vehicle or car which could merely pull to the side of the road and await or call assistance, a stranded boat is problematic and likely anxiety producing. If there is a breakdown of the motor of a road vehicle or even if the car will not restart, the motor vehicle occupants can simply wait for a tow truck for fixing, towing or jump starting the motor. If a dead or broken motor is present on a boat upon the water or a boat suffers any serious mechanical breakdown, this can be potentially dangerous, resulting in stranding of the boat and its occupants in the middle of the water (squalls can arise, for example) until another boat can come and pull it and the occupants to shore. It is also dangerous for occupants of a marine vessel to try to swim to shore. Relatedly, unlike a road car motor which can often have its motor jump started (in the case of a dead battery) by having another car sidle along side and "jump" the dead battery, most boats and other pleasure boats which might casually come to the aid of the "dead" boat (unlike emergency aid boats) do not have this capability. Therefore, the present invention seeks to solve the problem of a boat on the water, with a non-working or non-starting motor, which would be stranded without the use of the motor, especially important when the marine boat is in a remote area. The solution is provided by a simple to deploy, otherwise compact, portable emergency motor or drive unit. Once deployed, the emergency motor for the boat can take the boat and its occupants back to safety on shore or at least to another boat for aid. Yet, when the emergency motor of the present invention is not needed, it is easily stowed and does not take up too much space (usually at a premium on small and medium size motor boats) so that the present invention can be carried in even small or medium size boats, ready for deployment and use, if the need arises, without taking up critical space on the boat.

The emergency motor can preferably be battery powered, either directly linked to the main battery of the motor boat or supplied and powered by a separately available battery (12 volt; 24 volt or even 36 volt). It could also, yet not preferably, be a small gas engine with a small reserve tank of gasoline associated therewith. Preferably, the emergency motor will be connected (via a drive shaft preferably passing thought the center of a support set of pipes or tubes) to a water engaging propeller. Other embodiments are available, too, as will be seen and described.

BACKGROUND OF THE INVENTION AND DISCLOSURE

Marine vessels often include an outboard motor(s) or an inboard motor(s)—sometimes the boats are powered by multiple oars and/or wind. Often boats are powered with some combination of the various powering mechanisms, all to provide propulsion when desired. The passengers on a small recreational vessel are highly dependent on the reliability of the power system and the primary powering mechanism, especially once away from the original point of land/shore. In case of mechanical failure of the powering mechanism for the boat, generically herein referred to as the motor (breakage in a critical component (propeller, gears, mast, loss of fuel, insufficient battery to restart the same, etc.)), which, sadly, seems not to be uncommon, the vessel and its occupants are substantially rendered helpless. They will need to use some communication system or device, e.g., ship to shore or cell phones, etc. to call for aid. This, however, assuming communication is available, can be very timely, sometimes scary depending upon weather conditions, and frustrating. Often, even if emergency help is dispatched, locating the stranded vessel is problematic and the speed of the emergency vessel not always great, hence the time to rescue seemingly long. This is very uncomfortable for the boat occupants, especially if storm clouds are present or a squall on the horizon. Thus, an emergency available alternative power-providing mechanism which is carried aboard of the boat and which takes up a minimum of space until needed is highly desirable. However, it is important for the device so provided that it does not take up too much room and that it be capable of quick, simple and effective deployment, when needed. Also, the emergency powering device, if designed or engineered to utilize common on board mechanisms for securing the same in position, seems highly advantageous and desirable.

While a sea towing vessel or a nearby other marine or water vessel may provide assistance in some instances, such cannot be depended upon and, in any event, the length of time of seeming helplessness is very disconcerting and frustrating. Providing an emergency-available device, even if it only moves the otherwise stranded boat at a small speed, is a great relief to the occupants. The decrease in anxiety for the occupants can be great, just knowing that the boat is moving in the right direction, albeit slowly—towards safety. If the vessel in distress is in a remote location or is otherwise unable even to contact assistance, the vessel and its passengers are in peril. Speed of the emergency aid vessel is not always the issue, but, rather, communication to alert the shore or another vessel of an emergency situation and location become primary. Here, again, knowing that the marine boat in distress is moving, with even a small motor, is a great sense of relief to the occupants.

The present invention is an emergency-available, collapsed until needed, small powering unit for the boat. It is compact, capable of being deployed quickly and, yet, after use can be collapsed back to its storage condition by easy disassembly. Use of the emergency drive unit can be accomplished with ease and it will provide emergency auxiliary power for the boat. Preferably, the device is secured onto either side of the boat or transom by a supporting, vertical pole which slides into the commonly available standard anchor light sockets or receptacles which are often already present on the side walls or transom of boats. The vertical support is provided with a clamping block through which one of the relatively short tubes or piping (connecting the auxiliary motor on one end to the integrated propeller of the emergency drive unit on the other end) is rotatively secured. This allows the drive or auxiliary motor on one end of the long connected together piping to be balanced with the propeller on the other end of the long piping with the fulcrum point for balancing the motor and the propeller being the vertical support post, itself preferably held in the anchor light socket on the gunwale of the boat. Running down the central shaft of the assembled tubes or piping is a drive shaft, often flexible but not necessarily so, which transmits the power of the drive or auxiliary motor to the rotation of the propeller placed into the water.

Other securing mechanisms are contemplated for holding the assembled tubes or piping at the side wall of the boat in the situation where an anchor light receptacle is not present or only inconveniently present. So, for example, a mechanism can be used which secures the assembled long poles to a cleat, to a flag pole holder, to a fishing rod holder, to the grab bars, to the canopy support, etc. In most embodiments, the connecting tubes or piping are adjustably secured within a clamp block and the clamp block held by a vertical extending rod which is secured to the side wall of the boat, to the cleat, the fishing rod holder, to the flag pole holder, to the anchor light receptacle, etc.

According to the invention, the auxiliary or drive motor of the present emergency device is either hard wired, plug and "play" wired, or otherwise capable of being connected to the main source of power on the boat, e.g., the battery (12 volt; 24 volt or even 36 volt battery can be used for driving the motor of the device). The battery used for the main engines of the vessel can be used or the device can be provided with its own small battery or power supply for powering the same as and when needed.

Accordingly, there is a perceived need for an emergency marine motor that is highly compact when stored and not needed but which can be quickly and easily assembled and deployed in an emergency situation. After use, the device can be simply disassembled for re-storage for use again in an emergency situation. The device should be stored compactly to reduce taking up valuable space onboard the vessel and, preferably, be easily and quickly assembled and secured to the vessel in a manner which ensures that the motive force is transmitted to a rotating propeller placeable into the water, which is safely and effectively held there, with the support for the device on the side wall of the boat being accomplished by using available mechanisms already aboard many boats, even small or medium size boats.

The present invention, an emergency drive unit for a marine vessel, basically comprises a long (when assembled) telescopically connected (bayonet type coupling, male and female connectors, screw threads, or ball and detent couplings, etc.) and collapsible, disconnectible or able to be broken down (for storage) set of piping or tubes holding an electric powered small motor on one end of a first tube or pipe, corresponding to the drive section, and a propeller on the other end of the pipes or tubing corresponding to the driven section, the rotating shaft of the drive motor being mechanically connected to the propeller by a flexible shaft travelling along the length of the pipes and tubes, preferably down their bores. A rotational output drive shaft extending from the rotating shaft of the auxiliary or drive motor is preferably parallel and more preferably housed within the pipes or tubing. A first section of tubing or pipe (or two such sections—a first section and center section(s)—for increasing the length between the motor and the propeller so that the propeller is beneath the surface of the water for powering the vessel) is connectable to the drive section with the motor and its rotating shaft and also connectable to the driven section of piping. The rotational shaft of the motor is secured to a flexible drive shaft or a solid drive shaft running down the center of the pipe(s) and tubing pieces. Alternatively, the piping or tubing can have the flexible or solid drive shaft supported beneath it and parallel thereto, with supporting hooks or O-rings extending below the piping and tubing and holding the drive shaft. In any event, the flexible or solid drive shaft (whether within or parallel and outside of the tubes/pipes) runs along and parallel to the length of the tubes/pipes and has a rotatable propeller secured to its driven end which suitably attached to the distal end of the drive shaft. The tubing/pipes provide support to the motor and rigidity and support to the rotatable shaft of the motor. The rotatable flexible or solid drive shaft with the propeller at its distal end extends into the water. When the small battery-powered motor is energized i.e., connected to the power of the battery or other source of fuel/power, the shaft of the motor rotates and that, in turn, rotates the solid or flexible drive shaft, which, in turn, rotates the propeller in the water, moving the same in the water and thus driving the boat. Control of the motor is accomplished by a spring loaded "return to off" twist or thumb lever safety throttle, near the motor and likely secured to the drive section, just like that of an outboard motor. A reverse direction for the propeller can also be provided. The present invention is not specifically intended for directional propulsion as the rudder of the boat can still provide the same, although it is also within the contemplation of the present invention for the direction of the propeller in the water to be turned and adjusted, too (preferably about the vertical support shaft preferably held in the anchor light recess or receptacle during an emergency because the onboard steering does not often respond quickly when a boat is moving at slow speed). Alternatively, of course, some mechanical mechanism can be provided for selective turning of the direction of the propeller to facilitate steering of the vessel. Or the boat can be steered by easy rotation of the long assembled pipes about the axis defined by the vertical support rod (held within the anchor light recess).

The connected tubes/pipes provide the mechanical support for the small motor, on one end, and for the rotatable flexible (or solid) shaft through the center or hollow sections of the tubing/pipes, with the propeller (of the driven end) extending out of and being supported on the other end of the flexible shaft and the tubing/pipes. Preferably, the piping, is comprised of two or more short (with no section preferably being longer than 3 feet, for storage purposes) tube/pipe telescopic sections (collapsible or at least disconnectible from one another when not in use and for compact storage). A central section, between the drive section with the motor and the driven section with the propeller, consists of a first section which is preferably secured within the anchor light receptacle of the boat, after the light has been removed. Alternatively, the vertical support of the device is held to a side wall of the boat by another mechanical mechanism, one which either cooperates with already onboard features of the vessel, e.g., fishing pole holders, grab bars, or cleats, or with some additional mechanism for securing the same in relative position. The length of the overall assembled device, from motor to propeller can selectively be extended by insertion of one or more lengths of pipe/rods. This added central section, for increasing the length of the overall device, can be provided depending upon the length of the boat and height of the side walls of the boat. The central section is comprised of a support or first section with a vertical support post or arm and the extra center section(s), if needed. Preferably, this support arm extends from the first section of the piping and at an angle to the longitudinal axis of the constructed tube/piping. This support arm is intended to be slid into, located and supported within a cylindrical recess in the gunwale of the boat—conventionally available in many motor boats and referred to as the anchor light sockets, or within fishing pole holders, or in flag pole holders, or by a mechanical coupler to a cleat of the motor boat or to the grab bar rails extending around the front or sides of the boat, etc. In any event, the first section is secured within a connector block which is secured to a vertical pipe or support which is secured into the side of the boat, preferably within the anchor light socket (after the light has been removed, leaving behind the exposed cylindrical recess for accepting the vertical pipe or support of the invention). The connector block is intended to allow the tubes/piping of the first section to slidably adjust the relative location of the motor on one end and the propeller on the other end, in relation to the boat. This allows a careful balancing of the two ends (with the connector block being the fulcrum point) and ensures that the propeller is under water for propulsion and safety.

The cylindrical recesses of the boat are frequently already available in the sides of small marine vessels and serve a variety of other purposes, e.g., support of fishing poles, support of flags, support of emergency lighting for night time boating, etc. Those recesses are thus available for use as a location to place the support pole of the connector block of the emergency drive unit.

At the middle of the first section of metal tube or rod (two metal tubes i.e., a first section and center section(s) can be connected together if increased length is desired between motor and propeller) and located a few feet away from the motor, is the adjustable clamp block. Preferably, it has a ball and socket swivel connection with a vertical pipe support. The vertical pipe support fits into the cylindrical recess on the side of the boat and the ball and socket connection of the clamp block slidably secure the first section of the piping. Thus, the first section is slidably adjustable within the connection and the angle that the first section of tubing defines with respect to the side wall of the vessel is changeable and adjustable, too—a consequence of the ball and socket connection. The clamp block holds the first section but also provides a simple ball and socket swivel joint. The clamp block is preferably formed of a high impact plastic and is both horizontally and vertically adjustable around the ball (located on the top end of the vertical section of support piping or tubing). That is, the ball is provides the swivel point for the clamp block, secured around the first section of piping. The ball is at the top of the vertical pipe support. So, with the lower end of the pipe support held within a cylindrical recess of the anchor light socket or receptacle in the side of the boat (or within a fishing pole support having a cylindrical recess) the ball allows the clamp block to rotate and move and this, in turn, connected to the tubing/pipes of the emergency mechanism, allows the rotating drive shaft (flexible or solid) and the propeller to be precisely adjusted and moved, as required to ensure balance and contact of the propeller with the water, yet not too deeply. The clamp block is secured around the ball and is held around the ball of the vertical pipe support by preferably quick fasteners. Use of quick fasteners allows for quick and simple adjustment without the need for special or available tools. This adjustment, i.e., release and tightening of the fasteners to hold the clamp block to the ball of the mechanism holds the clamp block around the ball and allows it to swivel in a ball and socket manner—tight enough to maintain the ball within the socket and yet the ball is free to be moved and frictionally hold its new and stable, balanced position within the socket/clamp block. The ball is attached and at the top of the vertical post (the pipe support) which can slide into the cylindrical recess of the boat—a standard anchor light socket in the side wall of the boat after the light has been first removed. That removal thus exposes the cylindrical, substantially vertical (yet sometimes slightly canted or angled) recess for receivably sliding therein the vertical pipe support of the present invention. The pipe support, the distal end of the pipe piece being the ball component of the ball and socket mechanism, slides into and is captured by the cylindrical recess. This eliminates the need for a boat owner to purchase or own any additional tools or pieces when use of the present invention is desired. However, if there is no standard mounting mechanism on a particular boat, thus preventing connection of the present invention to the already-provided receptacle attached to the gunwale of the vessel, a "dumbed down" or newly installed receptacle, like an anchor light socket, can be provided as a receiver and it can be installed by a dealer or marina or even by the boat owner.

In an emergency, the telescopic pipes (drive section, first section (extra center section(s), if required) and the driven section) are snapped or screwed/connected together (ball and détente coupling, bayonet type coupling, screw threads, etc.) and the central vertical pipe support of the first section (with ball within the socket of the ball clamp) is slid into the cylindrical and exposed anchor light socket (after the light is first removed, if necessary) and the propeller, mechanically coupled to the rotatable shaft of the motor by the flexible shaft of the device (extending from motor to propeller) is placed into the water. The motor on one end and the propeller on the other end of the connected-together pipe sections are slidably adjusted in the clamping block for balance and location and then the thumb screws tightened. Angular positioning of the first section (and thus the connected drive and driven sections) is also effected, again, through the adjustability of the clamp block around the ball of the vertical support pipe. Then, activation of the motor, by a simple switch, will cause the drive shaft of the motor to be electrically (or other fuel) connected to a source of power which causes the motor's shaft to rotate which causes the flexible shaft attached to the shaft of the motor to rotate which causes the propeller to rotate, the latter connected to the other end of the flexible drive shaft. The propeller can be height adjusted in the water by movement of the central tube/pipe with respect to the vertical pipe support since the two are connected together in a ball and socket mechanism—secured yet adjustably so by the thumb screws of the clamping mechanism.

The vertically extending pipe support is configured to have a universal size and fit for standard marine light sockets. The present invention is thus designed to be utilized in substantially any size boat (preferably up to about 26 feet in length) because it allows the pipe support to be secured into quite universal and conventional, on-board, marine standard light sockets. This makes the invention extremely versatile, useful and a manufacturer and seller need only stock the standard size and the same can be used in wide variety of boat sizes. The present invention eliminates the need to make and stock different models for use with many different vessels, since the standard model fits all vessels with an anchor light socket, but alternative makes and models can be provided for, too. The only "extra" to be fitted for a particular boat is likely to be the need for one or more of the center section(s), the extra piece of pipe or tubing which lengthens the distance between the motor on the drive section and the propeller on the driven section.

Preferably the vertical support post is made of metal, but can be provided with a plastic end cap on its end to facilitate sliding into and attaching the pipe support into the light socket. The cap can be configured so as not to impact upon or with the electrical contacts within the cylindrical recess of the anchor lighting sockets. This vertical post of the present invention is the fulcrum point of the assembled together long tubing consisting of multiple pipe segments, having one end with the small battery-powered motor and the other end having the propeller—the drive shaft of the motor being connected to the rotation of the propeller by a flexible or solid drive shaft passing internally of the tubes/pipes or supported beneath the same.

The drive section, holding the motor on one end, is preferably a simple tube or pipe with a preferred length of about 1 foot. The next or first section comprises approximately three feet in length of tubing (the same internal and external diameter tubing as in the drive section) with a female to male coupling allowing the drive section to fit to the first section, much like the assembly of pipes in a home and conventional vacuum cleaner. Additional center section(s) is(are) available, identical to the first section, which can be added in case of the need to lengthen the present invention for a particularly high-in-the-water boat. The driven section of the tubes/pipes (at the distal end of the device, i.e., opposite the motor or drive section and adjacent the first section (and center section(s), if provided) with the pipe support and clamping block comprises another pipe or tube section, approximately three feet of piping or tubing with another male coupling to female coupling to the distal end of either the first or center section(s) (screw threads, bayonet coupling, détente and sockets, etc. or by use of slip fit different diameter sections, like a vacuum cleaners' pipe sections can be coupled together to form a long set of connected pipes, male fitting with female connection). Connecting the distal end of the first section or the center section(s) and the proximal end of the driven section, where those sections couple together, can be a water-tight "O-ring" to lock the pipe pieces together without water getting therein at the point of connection. At the distal end of the driven section (the section of the device opposed to that holding the small motor) is the propeller. The propeller is secured to the rotatable (flexible or solid) shaft which is secured on its other end to the rotatable shaft of the motor. Preferably, a cage-like guard surrounds the propeller (like a household fan guard surrounding the rotatable fan blades of a household electric fan) the cage-like propeller guard being a safety mechanism to protect against injury but also ensuring that the propeller does not become fouled or overly come into contact with weeds, tall grass, sand, reef, etc. which would tangle or damage the propeller and prevent the motor and propeller from being effective for their intended purpose. The entirety of the flexible or solid shaft, extending between the output shaft of the motor and the input shaft or coupling of the propeller (the propeller being preferably attached and secured over the distal end of the flexible shaft) is secured in a basic parallel manner within or external to the telescopic pipes. If the drive shaft is external to the tubes/pipes, it is held beneath the tubes/pipes by small metal supports or rings (like a shower curtain held to a shower rod) to hold the drive shaft parallel yet beneath the pipes to allow it to rotate so that the rotation of the shaft of the motor is imparted to the rotation of the flexible shaft which is imparted to the propeller. The rings hold and support the external flexible shaft (which dangles beneath the pipe segments) along the length of the connected pipes and allows rotation of the flexible shaft while holding the same in alignment with the pipe segments. As the preferred embodiment, however, the flexible drive shaft extending between motor and propeller is housed within the center bores of the drive section, the first section, the center section(s), if provided, and the driven pipe section.

Simple connecting mechanisms, preferably slide in and out connectors, screw connections, bayonet connections, ball and détente mechanisms, etc. can be provided for securely attaching all three (sometimes four or five) pipe sections of the present invention so that no tools are required for quick deployment and for easy collapsing, after use, for storage. This is important as a goal of the invention is for quick, easy and efficient use when a boat is on the water and primary engine or power failure is unexpected. Quick and effective deployment is highly beneficial. After use, the present invention can be collapsed (by disconnecting or mere telescoping of the pipe sections) so that each pipe piece can be stored in a small space with their lengths basically parallel and adjacent to the other pipe pieces (conserving length of the device when not in use). In this way, the device can fit in many places in and on a boat (even under seat cushions) where other items are stored, e.g., life vests. The overall device, when collapsed does not occupy much space at all, since the longest piece is only approximately three feet in length.

DESCRIPTION OF PRIOR ART

Motors for canoes, dug out boats, row boats, etc. have been used. Larger boats with inboard and outboard engines often have spare motors aboard in case of inoperability of one or more of the primary motors. However, to the inventor's and Applicant's knowledge, no prior art exists for a collapsible, disconnectible or able to be broken down and quickly deployable, small-size emergency motor (preferably electric powered) for a small boat or marine vessel. While it is certainly not believed inventive, merely good planning, to keep a spare motor in storage to replace the primary motor in case of mechanical failure, the present invention is not a mere replacement (except in the sense of providing needed motive power) of a motor which has stalled or died but, rather, the present invention is a small and compact, until assembled for use, motor with a quick mechanical means to attach the same to the boat, without the need to first remove the original now-inoperable motor from the stern. A motive force is thus available which is easy and safe to operate. To replace the primary (and now inoperable) boat motor from the stern could require getting underneath the boat while it is submerged in the water and/or going to the stern where the inoperable motor is located. Those engines are heavy and not easy to remove from the stern. The removal of the primary, now inoperable motor can be problematic whereas deploying the present invention, initially collapsed for ease of storage, by having it simply and easily secured into the existing emergency light receptacle of some small water craft is very effective, quick and requires little ability, mechanical knowledge or strength. All can be done on board and in a minimum of time. The present invention eliminates the requirement to secure the spare motor to the stern, eliminates removing the inoperable motor and allows a user in a boat to replace or supplement the boat's motor, in an easy and quick manner, while securing the same to the boat in a very simple mechanical manner. Also, providing a motive force through a turning propeller could be dangerous and, yet, the present invention is simple and safe to deploy.

There is a need for an emergency marine motor that can be deployed in an emergency situation but also can be stored compactly to reduce taking up valuable space onboard the vessel. Having such a device which can be secured to the boat in seconds, by placing a support pipe into the cylindrical recess already available in the side walls of many boats (the anchor light receptacle) is highly desirable. No prior art is believed directly on point.

SUMMARY OF THE INVENTION

The present invention discloses an emergency drive unit for boats in the water, and one which is small enough and lightweight enough to fit inside the boat without interfering with the boat's other mechanisms. It is intended to be used when a boat motor dies or is rendered ineffective for a variety of reasons, fouled propeller, unable to restart, lack of fuel, broken gears, fuel line blockage, etc. The present invention is an alternative for use when there is no readily available rescue boat, as well as an alternate to trying to swim to shore or fix the engine yourself.

The present invention comprises a set of aluminum and inter-connecting tubes or pipes which are adopted to be assembled, end to end, to provide length. The first section is provided with a vertical connecting post or support which can be selectively slid into the anchor light socket or cylindrical receptacle already present on many small or medium size boats. Thus, the present invention is intended to be capable of being used on a wide variety of boats without much work being done or mechanical holders being added to the vessel. Many boats are already provided with such a cylindrical receptacle along the gunwale or side of the boat. Attached to the vertical support post of the first section of the invention is a clamp block-ball swivel, acting upon and allowing the first section to be horizontally adjusted along the side of the boat and also allowing relative ball and socket rotation of the first sectional pipe with respect to the vertical support pipe. As the drive and driven sections of pipe are connected into the first section, they, too, are able to be adjusted with respect to the vertical support post. The sliding adjustment of the first section with respect to the vertical support pipe/post and the angular adjustment of the first section of pipe is made and then the clamp block is secured in final position by finger manipulation/screw tightening. The first section which is connected by the ball and socket connection to the vertical pipe support (itself maintained in the anchor light socket or a cylindrical receptacle) extends laterally, forwardly (towards the bow) and rearwardly (towards the stern) of the boat. Thus, the tubes or pipes (drive and driven sections with motor and propeller, respectively, and the extra center section(s), if required) extend in both directions from the clamp block. The ball swivel in the socket of the clamp block provides the metal tubes/pipes or rods with almost complete vertical adjustment about the fulcrum point of the ball and socket connection and angular rotation so as to allow location and placement of the propeller in a desired location around the boat, or remove it from the water if need be.

In one embodiment of the invention, the metal tubes/pipes or rod are hollow and the turning shaft of the motor, on the forward or bow end of the tube/pipe segment (called the drive section) passes therethrough, via a flexible turning shaft or a solid turning shaft. In another embodiment of the invention, the metal tubes/pipes are a support for the flexible or rigid turning shaft of the motor with the shaft being suspended below the connected-together pipes. Hooks or O-rings are provided for supporting the flexible or solid shaft of the device parallel yet beneath the piping. The hooks hold the flexible or solid shaft in place, parallel with the metal tubes/piping or rods, to ensure that the flexible tubing does not accidentally droop into the water. The spare or drive motor is harnessed onto the drive section of the piping, i.e., onto the bow-directed end of the connected-together metal tubes/pipes or rods. The motor is intended to remain above water while the propeller end of the assembled device is designed to be placed into the water. The flexible or solid rotatable shaft, providing drive force from the motor to the propeller, runs the length of the assembled tubing/pipes or rods. The motor is preferably driven by a battery.

A throttle mechanism is provided for controlling the speed of the motor and the direction of rotation of the propeller. The drive motor is either hard wired or removably connected to a battery (either the primary battery of the boat or a separate battery) and preferably held in a water tight manner. Powering the motor causes its drive shaft to rotate which causes the flexible or solid drive shaft of the device, connected on the motor's end to rotate, which causes the propeller to rotate as it is connected to the other end of the rotating shaft. Rotating the entire "boom" of the device, the length of the connected tubes/pipes, about the vertical support post held within the anchor light receptacle, provides the driver with a means for providing direction to the boat along with propulsion provided by the propeller. As a practical matter, once the propeller is in the water, a user can steer the propeller by holding onto the metal tube/pipe or rod with the motor on its end and maneuvering it in the water to change direction. Of course, if not disabled, the boat's rudder can be used for steering.

Other aspects, advantages, and features of the present disclosure will become apparent after review of the entire application, including the following sections: Brief Description of the Drawings and Detailed Description.

DETAILED DESCRIPTION OF THE DRAWINGS AND THE PREFERRED EMBODIMENT

Description will now be given of the invention with reference to the attached Figures. It should be understood that these figures are exemplary in nature and in no way serve to limit the scope of the invention as the invention will be defined by claims, and the scope of the invention will be the scope of the claims, as interpreted by the Courts.

Figure 1A:
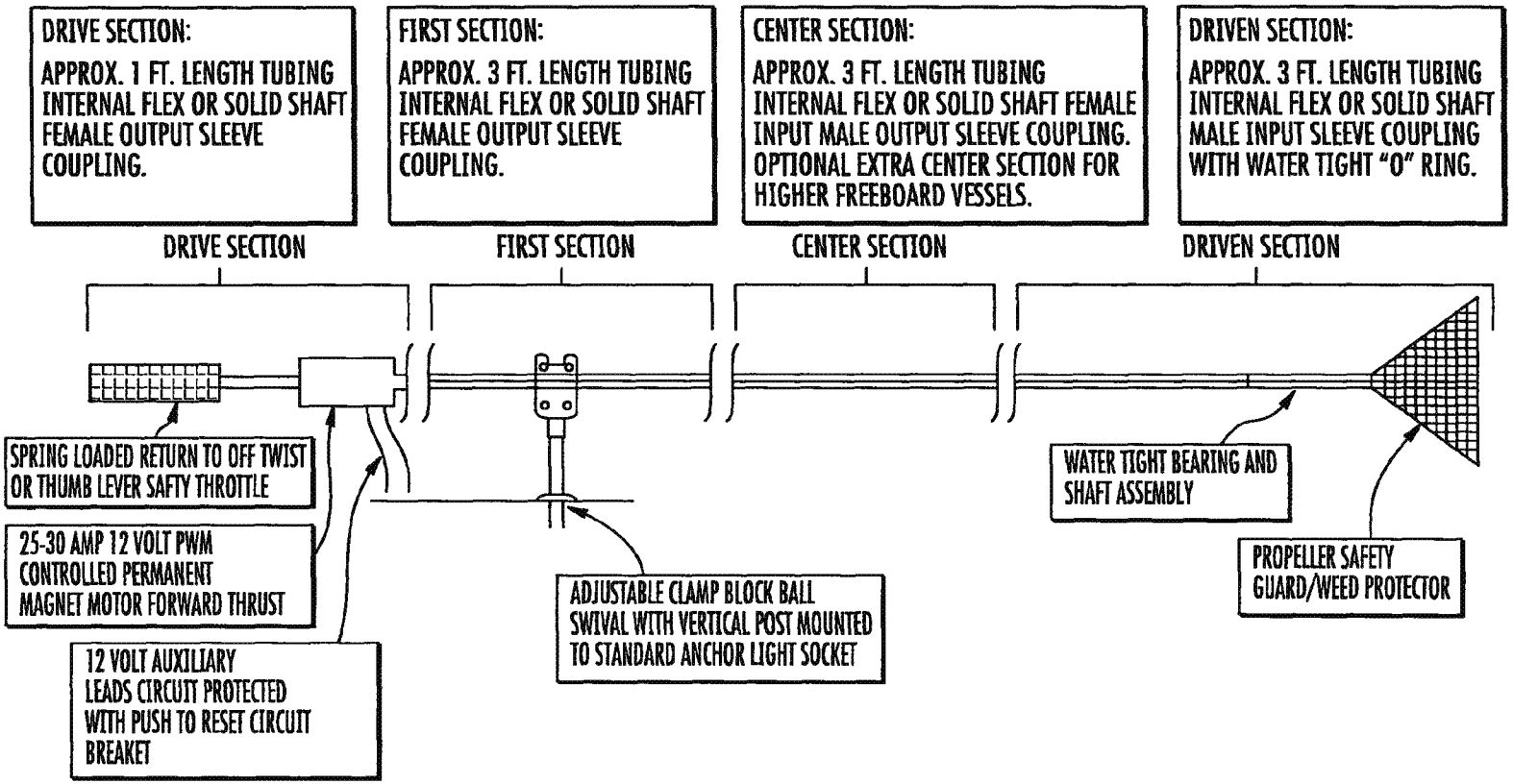
FIG. 1A is a schematic view of the basic components of the present invention—a drive tube/pipe or rod section holding the motor (with a throttle handle secured thereto); a first section of tube/pipe or rod and having the adjustable clamp block/swivel ball and a vertical post for securing the same into a receptacle in the gunwale or side wall of the boat; a center or intermediate section of tube/pipe or rod for selectively extending the length of the overall device to ensure the propeller sits below the water line; and an output or driven section of tube/pipe or rod (with the rotating shaft passing through the hollow centers of the three (or four or five) sections) for holding the propeller. Also schematically shown is a cage or safety guard around the propeller.
Figure 1B:
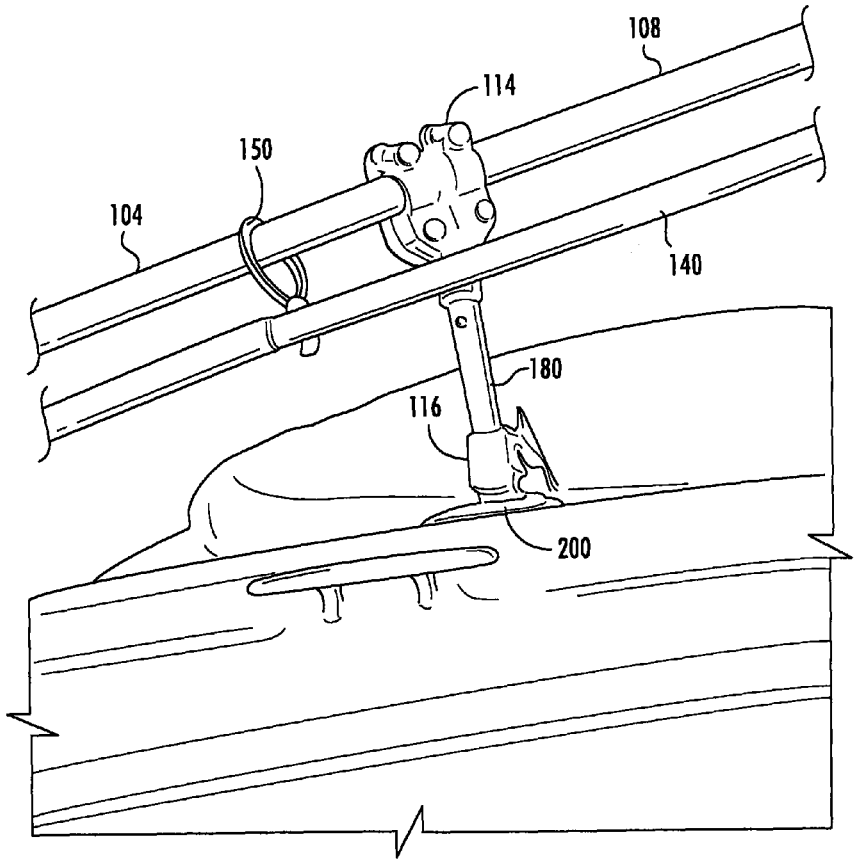
FIG. 1B is a side perspective view of the clamp block-ball swivel of the present invention used on a boat and holding the first section of tube/pipe of the overall three tube/pipe segmented emergency drive unit with the flexible drive shaft of the motor (not shown) being held by rings below and parallel to the tubes/pipes of the present invention, the vertical support rod is held within the cylindrical recess of the gunwale of the boat, where an anchor light is normally held in the receptacle.

The present invention discloses an emergency drive mechanism for boats which is collapsible to a small length when not in use (for storage) but which can be assembled and implemented when needed in a minimum of time. After use, the device can be easily disassembled and stored again, ready for re-use. Basically, the invention comprises two or more, preferably three (and where more length is needed even four or five) preferably hollow, aluminum rods, 102, 104 and 108, connected at their distal and proximal ends, respectively, by ball and detents, by screw threads, by a bayonet coupling, etc. The first section (actually a middle length of pipe or rods) is secured, when the device is put into its operable condition, to the distal end of the drive section of pipe and the distal end of the first section is secured to the proximal end of the driven section (the end holding the propeller). A schematic view of this can be seen in FIG. 1. The first pipe or rod 108 is part of the drive section. A motor 130 is strapped or otherwise secured to it. In this embodiment it can be seen that tightening clamps (available at automotive and hardware stores) can be used to encircle the circular base motor 130 and hold the same to the end of the first rod or drive section 108.

The drive section or tube/pipe or rod section has its distal end secured when the device is put into its use or in the ready for use condition (in any conventional manner, e.g., by screw threading, by bayonet coupling, by holes and spring-biased ball détentes and/or by any other means) to the proximal end of the first section 104, which is in turn connected in the same manner to the rod or pipe 102 of the driven section. In an alternate embodiment, center section(s) can be inserted or installed between the distal end of the first section and the proximal end of the driven section, to lengthen the reach of the connected piping, extending from the drive section holding the motor to the driven section, with the propeller. Of course, the device can be "knocked down" or disassembled, when storage of the unit is desired.

Similarly, for assembly, the driven section, comprising the output tube/pipe or rod section, also carrying the propeller, is secured to the center section(s) or, if that extension tubing is not required, directly to the distal end of the first section. The connection of the driven section to the center section(s) or to the first section is accomplished by having its proximal end secured, again, by conventional means (with or without a sealing O-ring) to the distal end of the center or first section. The three (or four or five) tube/pipes or rod sections, when connected, form a continuous, preferably hollow, length of pipe, one end of which holds the motor, the other end of which has the propeller secured thereto.

The first section is provided with a vertical pipe support. It is secured intermediate the drive and the driven sections. It is the first section, with its vertical support post or pipe, also in the nature of a tube/pipe or rod section, which is preferably slid into the exposed cylindrical receptacle (by first removing the anchor light from the cylindrical receptacle). Thus, the vertical support of the first section holds the horizontal pipe segment and also serves as the fulcrum point of the connected sections, extending from drive section to driven section. The vertical support, when held by the cylindrical receptacle of the boat, preferably an anchor light receptacle, securely holds the entire apparatus, connecting tubes/pipes or rods, driving motor, propeller and drive shaft—in position, ready for use. Alternatively, the vertical support can be secured to the side wall of the boat or vessel in another manner, for example, by suitable mechanical devices serving to secure the vertical support rod to a cleat of the boat, to a fishing pole holder, to a side or grab bar of the boat, a canopy support rod, etc.

The adjustable clamp block 114 connects around the circumference of the first section and/or the center section or rod and allows for relative initial sliding location of the first section and/or the center pipe or rod section with respect to the clamp block and the vertical support rod. The clamp block will, when its thumb screws are secured to the associated bolts, hold the relative placement of the first section and/or the center section piece in position with respect to the vertical support piece and the cylindrical receptacle into which the vertical support piece is located. The clamp block is preferably formed of high impact yet inexpensive plastic, is held in place tightly around the outer circumferential wall of the rod 108 by thumb turnable nuts 120 and matching bolts (held in place from rotation by the molded plastic around the heads of the bolts) cooperating with aligned holes in the two sides of the clamp block. The thumb turnable nuts 120 allow for easy sliding location of the first section and/or the center section(s), as required, for balance and location of the propeller into the water. The simple to tighten and untighten nuts and bolts eliminate the need for any special tools or hand tool use by the user.

The clamp block 114 has a centrally located ball-shaped cavity. The clamp block secures, within its ball-shaped center cavity, a ball, acting as a point of swivel 132. The ball is secured to the top of the vertical support post 180. The ball-shaped center cavity of the clamp block cooperates with the ball at the top of the vertical support post and they act as a ball and socket joint, providing both rotational adjustability and angle adjustment of the first section within the clamp block. Friction provided by the squeezing of the ball within the center cavity, by the action of the nuts and bolts being screwed together, holds the first section in place unless manually adjusted, whereupon the first section is again held by friction. Alternatively, the first section and the angle and rotation about the vertical support rod can be made and then the clamp block secured in position by use of the nuts and bolts, to generally hold the same in relative position. The ball, within the ball-shaped cavity of the clamp block, allows the pipe segment of the first section, passing through the clamp block (See FIG. 1, for example) to be adjusted as the ball and the ball cavity act as a ball and socket movable joint. Thus, excellent variety of adjustment of the rod of the first section, in terms of front to back, angle about the fulcrum provided by the ball of the vertical support post and rotation about the axis provided through the vertical support post are provided.

The vertical support post 180 supports and extends the cylindrical rods of the device above the surface of the side wall of the boat and allows the rods to also angularly move and rotate about the axis defined by the vertical support rod. The vertical support rod 180 is slid into the cylindrical receptacle 200 (otherwise used by the anchor lights, or within a fishing pole holder, within a flag pole holder, or is otherwise secured to the side wall of a boat, e.g., to a cleat, to a holding or grab bar, etc.). A plastic stopper 116 on the free end of the vertical support can be provided to cover the electrical contacts of the anchor light receptacle without harming those contacts. Depending on the maker of the anchor light socket, the plastic stopper may not be needed because the vertical support post 200 may sit perfectly in the anchor light socket without making contact with the electrical components located at the base of the receptacle.

Figure 2:
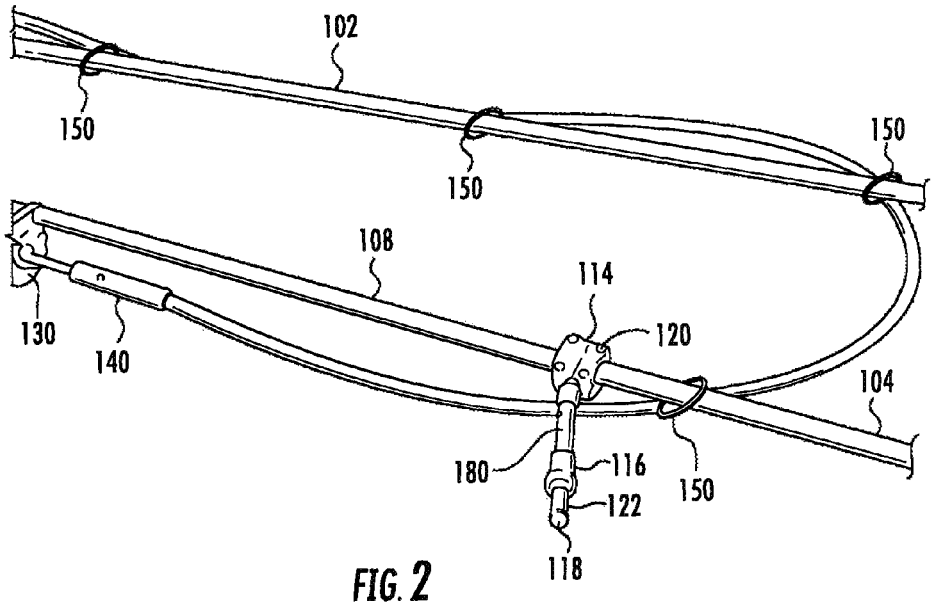
FIG. 2 is a top, partial perspective view of the present invention, in its disassembled condition, with the first tube/pipe or drive segment connected to the first section and the first section shown as detached from the distal, driven or propeller section. The motor is barely shown but its rotating shaft, connected to the flexible shaft of the device is shown. This figure shows the vertical support rod and the clamp block for holding the first section of the tube/pipe. The flexible drive shaft extending from the rotatable shaft of the motor and secured by rings to the tubes/pipes is also shown but the propeller is not shown.
Figure 3:
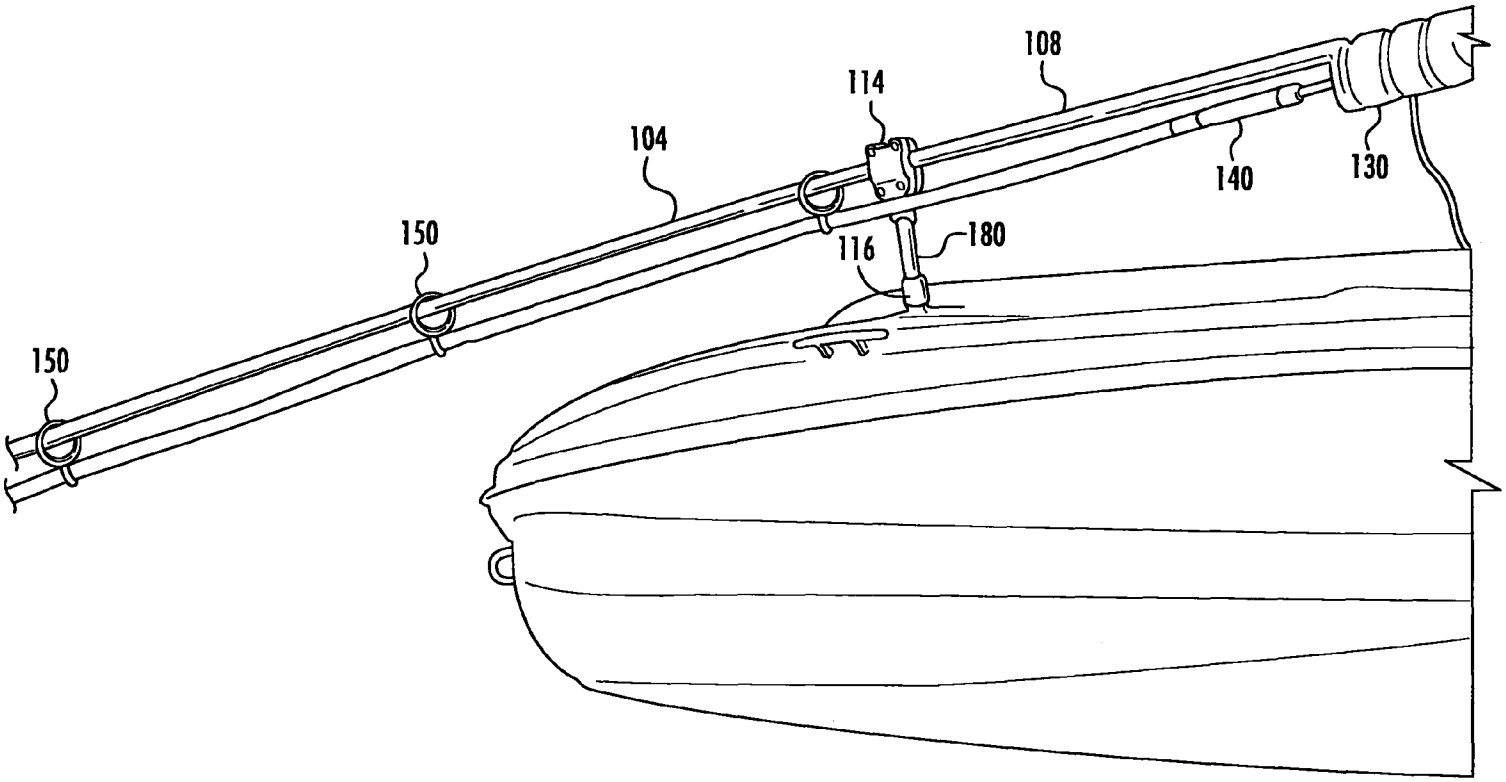
FIG. 3 is a side perspective view of the present invention, an emergency drive unit, in its condition as being used for emergency power for a small boat, with the propeller shown beneath the surface of the water, with the first section, the tube/pipe being held by the vertical support pipe as it is located in the cylindrical recess in the side of the boat and also showing the motor, suspended and attached to the drive tube/pipe section and the flexible drive shaft, suspended on O-rings or hooks beneath the tubes/rods, shown connected to the drive shaft of the motor, all as secured to a boat in the water.
Figure 4:
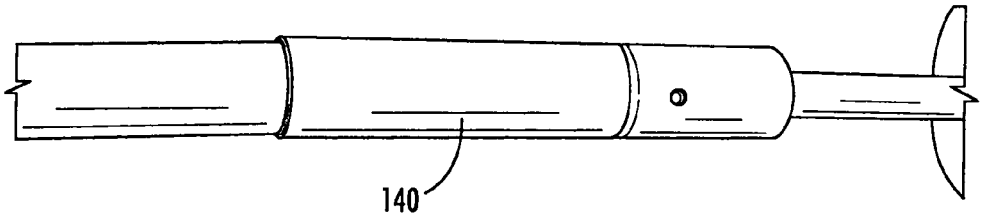
FIG. 4 is an enlarged and close-up view of one of the metal tubes/pipes or rods, with the drive shaft suspended therebelow (and parallel thereto) with a connector encasing the flexible shaft to protect the same from water damage and seepage. This is the connection between the drive shaft of the motor and the flexible or rigid drive shaft of the device, transferring rotational force from motor to propeller.
Figure 5:
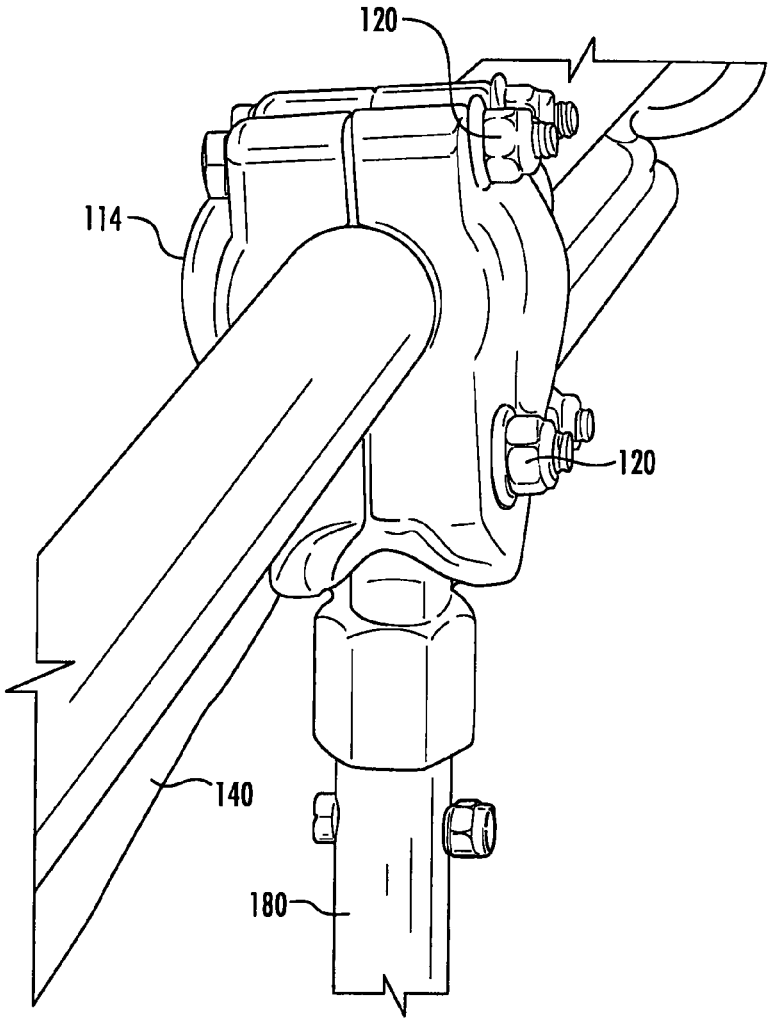
FIG. 5 is an enlarged and close-up perspective view of the front of the clamp ball-block swivel connection of the present invention (showing the vertical pipe support of the first section or tube/pipe or rod) and the first section passing through the central channel of the clamping block. The nuts and bolts for securing the clamp block around the encased ball at the top of the vertical support post are shown, too.
Figure 11:
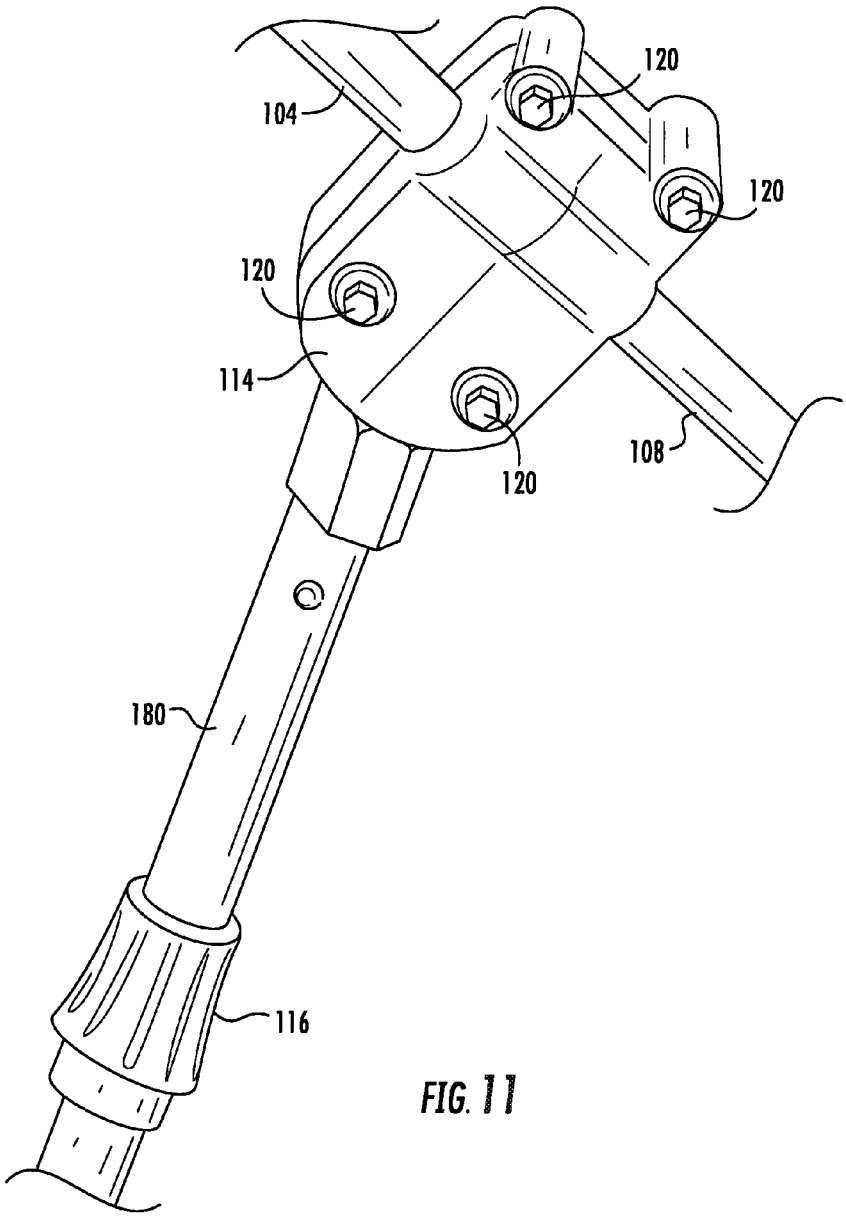
FIG. 11 is a side perspective and enlarged view of FIG. 5, showing the clamp block-ball swivel connection of the present invention and showing the vertical pipe support of the first tube/pipe or rod. The nuts and bolts for securing the clamp block around the encased ball (at the top of the vertical support post) and for securing in position the placement of the first section or pipe segment within the clamp block, are shown, too. In this embodiment the first section has the flexible drive shaft (extending between the shaft of the motor and the propeller) housed within the hollow bores of the pipes of the first section, the drive section and the driven section.

A close-up view of the clamp block and ball swivel is shown in FIGS. 2, 5 and 11. The plastic stopper 116 is slidably adjustable on the vertical pipe support. As can be seen in the Drawings, there is expected to be about 2 inches of length to the pipe support when slid into the anchor light receptacle of the boat and about 6 inches of pipe support extending above the plastic stopper 116. This will support the tubes/pipes or pipe segments of the device to about 6 inches above the surface of the side wall of the boat. A small plastic cap 118 with a female coupling can be secured into the hollow end of the vertical support post or pipe 122 and that cap 118 will cover and protect the male contacts or male anchor light socket segments 200 on a boat. On the vertical post, about two inches above the plastic cap 118 and about six inches below the ball swivel 132, is the plastic pipe end stopper 116 which is intended to cover the wedge within the top of the anchor light socket 200 and locate the vertical support post in place. The two or so inches below the stopper 118 of the vertical rod 122 allows the vertical support post or rod 122 to sit firmly in the cylindrical light socket receptacle 200 without shifting, and the six or so inches above it allow the metal tubes/pipes or rod element (especially the first section) and flexible or solid rotatable shaft extending between the motor and the propeller, all connected to the clamp block and ball swivel, to clear the top of the gunwale of a boat.

Figure 6:
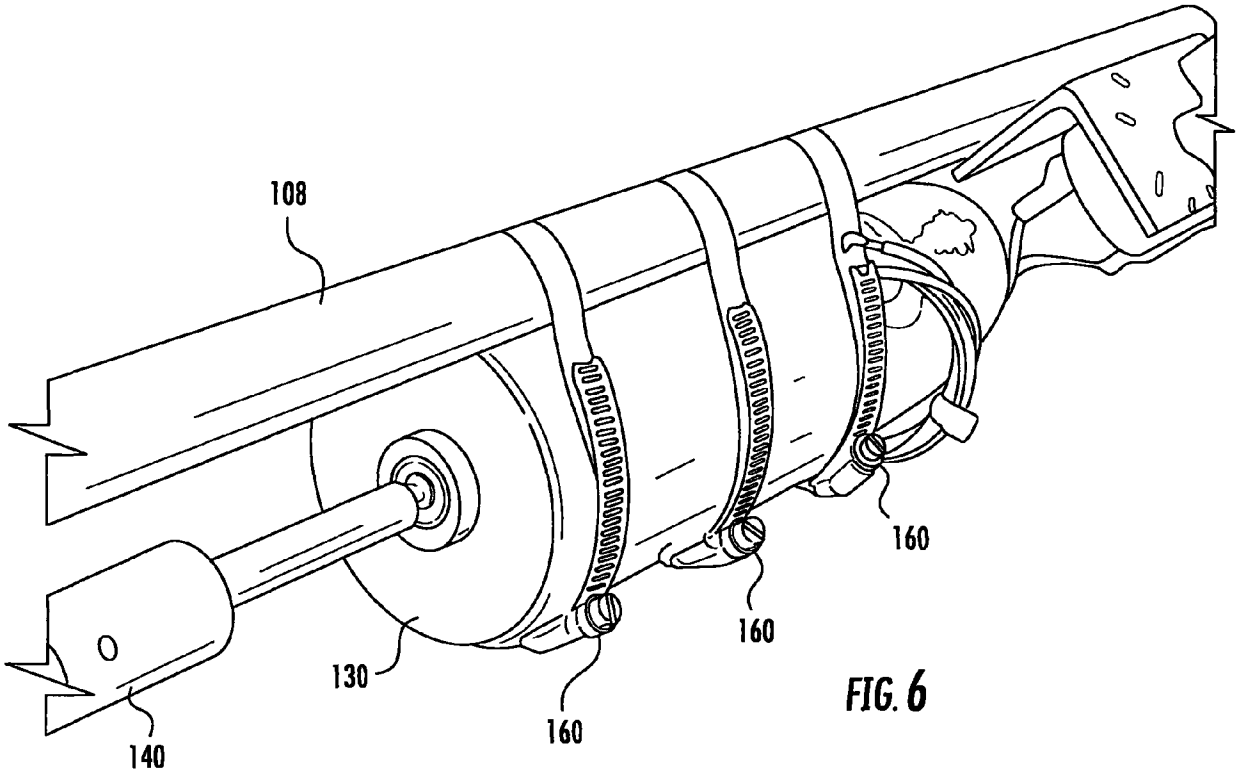
FIG. 6 is a side perspective view of the drive motor attached by clamps to the drive section or the drive tube/pipe or metallic rod and showing the rotatable shaft of the motor secured to a coupling for the flexible (or solid) drive shaft of the device (as shown in FIG. 4)

As shown in FIG. 6, a small motor 130 is harnessed to one end (the proximal end) of rod 108 of the drive section. In the preferred embodiment, the motor 130 is a 25-30 amp 12-volt pulse width modulation-controlled permanent magnet motor, and is controlled by a spring loaded return to off or thumb lever safety throttle. Of course, the motor can be driven by a 12 volt battery or the motor can be attached to a 24 or 36 volt battery. The motor can be coupled, by suitable connectors, to the main battery of the vessel or it can be connected to a separate battery. The motor and its electrical wiring are all held stationary and attached to tube/pipe or rod segment 108 of the drive section by belt-like metal harnesses 160 with turning screws for securing them in location with the harnesses being tightly around the rod and the cylindrical housing of the motor. This is all done by the manufacturer of the emergency drive unit, not by the user at the time of need/emergency use. Protruding from one end of the motor 130 is its rotating shaft. The rotation shaft of the motor is secured to a flexible or solid rotatable shaft which transmits the driving force of the motor to the propeller. The flexible or solid shaft 140 either passes through the hollow bores of the aligned tubes/pipes or rod segments or is secured and suspended beneath them by hooks or O-rings (similar to how a sail slides on a boom of a sail boat). The hooks or O-rings 150 act like the shower curtain hooks connected over a shower curtain rod such that the curtain is suspended beneath and parallel to the curtain rod. Here, the flexible or solid rotatable shaft, if not passing through the hollow aligned bores passing through the center of the drive, driven and first (and center) tubes/pipes or rod sections, will be suspended beneath and parallel to the support rods.

The propeller 101 is secured to the distal end of the flexible or solid rotatable shaft, as it emerges from the distal end of the driven tube/pipe or rod section or if supported beneath the distal end of the driven end of pipe. The propeller is directly connected to the rotatable shaft so that rotation of the shaft of the motor causes rotation of the rotatable shaft (solid or flexible) which causes rotation of the propeller. The propeller, if submerged in water, will propel the boat. Of course, this is accomplished by the motor being connected to the battery power and the spring loaded "return to off" twist lever or safety throttle, located proximal to the motor being activated. The motor can be single rotationally directional or can be reversible and the throttle control can be designed, accordingly. The direction of movement of the boat can be provided by rotation of the sections of tube/pipe or rods about the vertical axis defined as that which passes through the vertical support post of the first tube/pipe or rod section and/or with the aid of the boat's rudder or another steering mechanism.

The propeller is preferably encaged in a safety guard/weed protector 103. If the flexible or rigid shaft passes through the center bore of the pipe sections, the rigidity of the tubes/pipes or rod sections 104 and 108 of the drive and the driven sections, along with the tube/pipe or rod section of the first section, supported by the vertical post in the anchor light receptacle, keep the flexible shaft 140 in place and from drooping into the water. If the drive shaft is supported by hooks or O-shaped rings suspended below the pipe sections, the shaft will again be supported and held above the waterline, at least until a point near to the propeller. Without being suspended from the bottom of the metal tubes/pipes or rod sections (or passing through the hollow bores or the center of the tubes/pipes or rod sections) the rotatable shaft and thus the propeller could be very difficult for a user to maneuver.

Vertical post 116 protrudes vertically from the boat when attached to the anchor light receptacle or socket, and has the ball swivel 132 and socket elements. This mechanism, shown in FIGS. 2, 5, 10 and 11, allows a near-360° rotation of the clamp block 114 around the ball swivel 132, with the only prevention of full rotation being the tube/pipe or rod section 108 making contact with the boat as it rotates. A full horizontal rotation of the clamp block 114 is achievable around the ball swivel 132, and a partial vertical rotation is possible as well. This allows a user to place the propeller end of rod 104 into the water, in the direction and position of his choosing, and also to remove the propeller from the water if it is no longer needed.

Figure 7A:
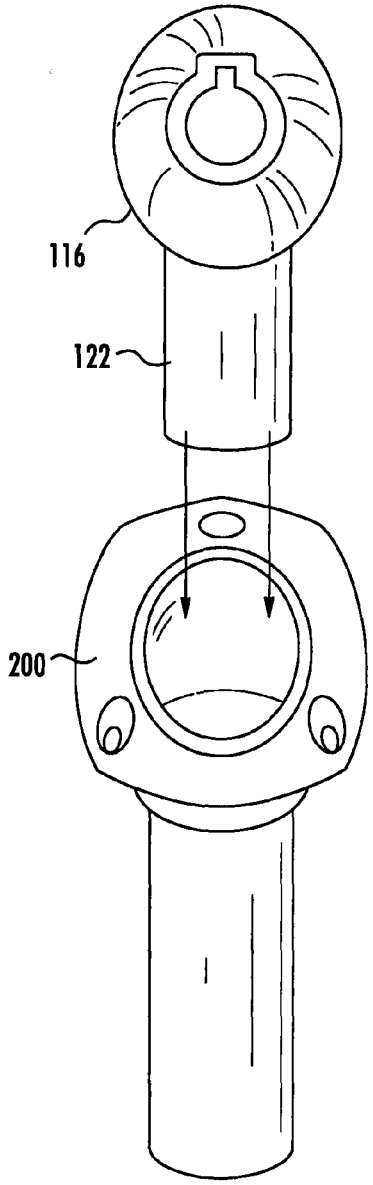
FIG. 7*a* is a front perspective view of a cylindrical recess of a fishing pole holder which can be deployed for holding the vertical support post of the present invention, as it is capable of being slid vertically into either an anchor light receptacle or another similar vertical or basically vertical cylindrical receptacle of a boat.
Figure 7B:
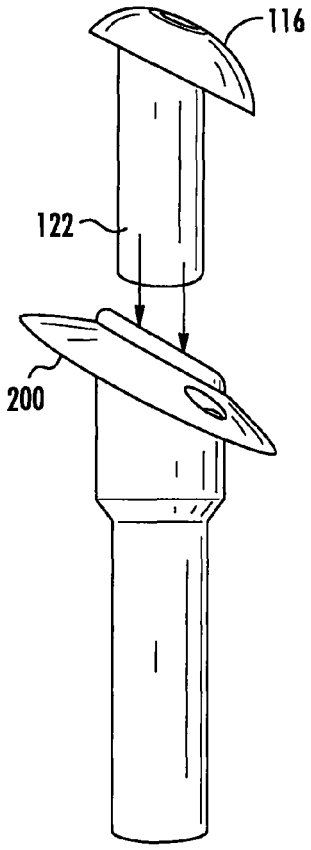
FIG. 7*b* is a side elevational view of FIG. 7*a* showing the cap which is removed, too, along with an inner sleeve for opening the cylindrical recess and allowing a user to use the receptacle for location and holding of the vertical support of the first section, which can be slid therein.
Figure 8A:
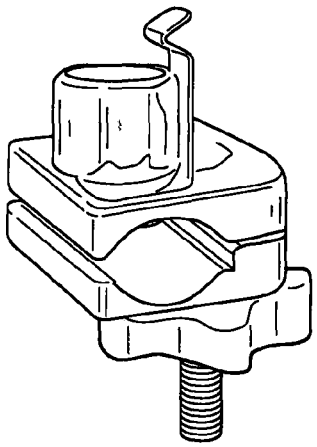
FIGS. 8*a*-8*d* are alternative devices (some of which are already in existence and available for purchase by boat owners) which can be used in connection with the present invention in that they provide support for the first section, specifically the vertical support post, to facilitate attachment of the first section or the tube/pipe or rod section of the present invention to various existing components of a boat (to a cleat, a holding rail, a horizontal rail or grab bar, the canopy supports, etc.)
Figure 8B:
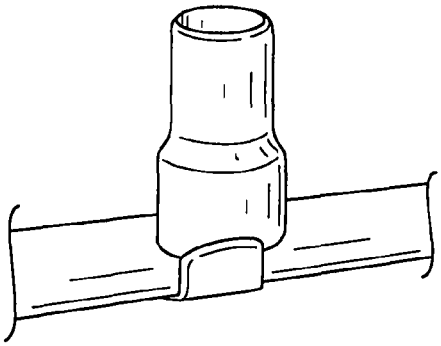
Figure 8C:
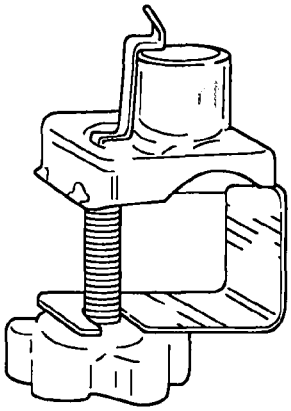
Figure 8D:
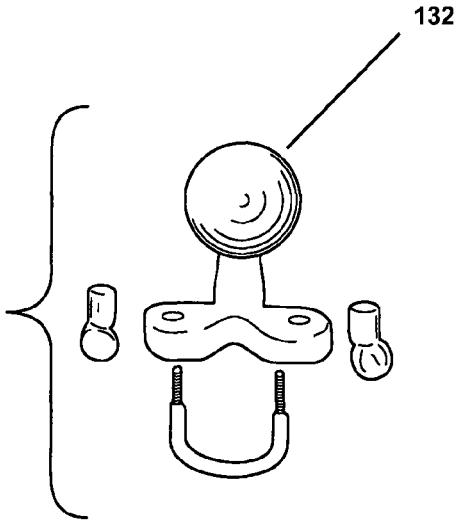
Figure 9A:
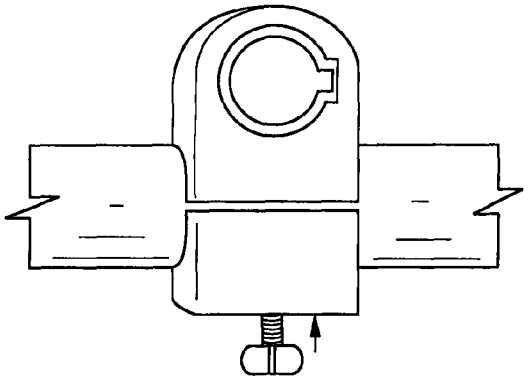
FIG. 9*a* is a front perspective view of a device which can be secured to a grab bar on a boat and is thus available to secure the vertical support post of the first section of the tube/pipe or rod element of the present invention.
Figure 9B:
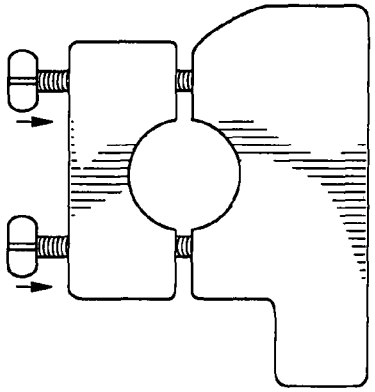
FIG. 9*b* is a top view of FIG. 9*a*.
Figure 9C:
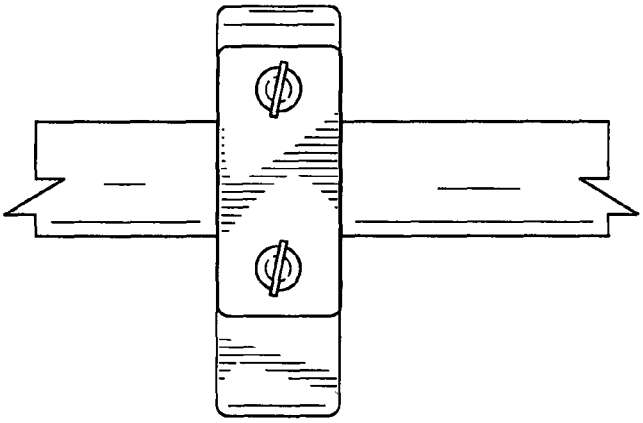
FIG. 9*c* is a side elevational view of FIG. 9*a* with a central opening for holding the vertical support post of the first section of the present invention, showing in phantom, the vertical support post as it would be secured in the central cylindrical recess and showing an angled holding of the vertical support post with respect to the grab bar on a boat.

The present invention is designed to mount in a standard anchor light socket or receptacle. It can also be mounted into a fishing pole receptacle. This can be accomplished by adding an optional fishing pole plug receiver mechanism into the existing pole holder that seats the vertical supporting post, as shown in FIGS. 7*a* and 7*b*. However, if an anchor light socket or similar receptacle is not present, there are other available options to attach the present invention to the side wall of a boat. A flush mount horizontal or vertical add-on socket is an optional mechanism. This could be original equipment of the boat or a simple add-on option which the purchaser of the emergency drive unit will have installed to the boat. Additionally, there are many flag pole mounts available currently for rail or grab bar mounting, as shown in FIGS. 8*a-d*. A mounting could also be provided for attaching the vertical supporting post to an optional cleat mechanism on the side of the boat. These mounts are not limited to horizontal rails; optional other mounts can be obtained or custom manufactured to attach to other surfaces/hardware such as but not limited to a grab bar mount, as shown in FIGS. 9*a-c*, a fishing rod holder mount, a cleat mount (slidably secured together and holding onto the cleat); a cup holder mount; an engine block mount, or even a canopy mount.

The device of the present invention is made up of preferably three but likely four or five main sections—a drive section, a first section, center section(s) (to add length, where required) and a driven section. The drive section of the present invention preferably comprises approximately one foot in length of tubing with a male or female distal end sleeve coupling. This is the section which holds the motor. The end sleeve coupling of the drive section comprises a preferably rigid hollow cylindrical segment which telescopically fits over (to maintain the outside circumference substantially uniform from one end to the other) the slightly reduced in outside circumference proximal end segment of the first section. In turn, the first section couples to either the (center section(s) if they is(are) present) or to the driven end. If a center section(s) or extender(s) is(are) present, it(they) will preferably connect between the first section and the driven section or they could be used between the drive section and the first section. The drive section has the motor secured thereto, connected preferably by hard but connectible and disconnectible wiring to a source of power, preferably a battery. Controls are provided to control the speed and direction of the rotation of the rotatable drive shaft of the motor. The drive shaft of the motor is connected to a flexible or solid drive shaft which extends along the length (suspended or internal) of the connected together pipe segments.

The first section is the supporting section for the rods and it is this section which holds the device to the boat, as mentioned, by a vertical supporting post preferably held in an anchor light receptacle. The driven section is the rod or pipe segment which holds the end of the rotatable drive shaft and allows it to be secured to the propeller. The driven section thus secures the propeller and the guarding cage.

Figure 10:
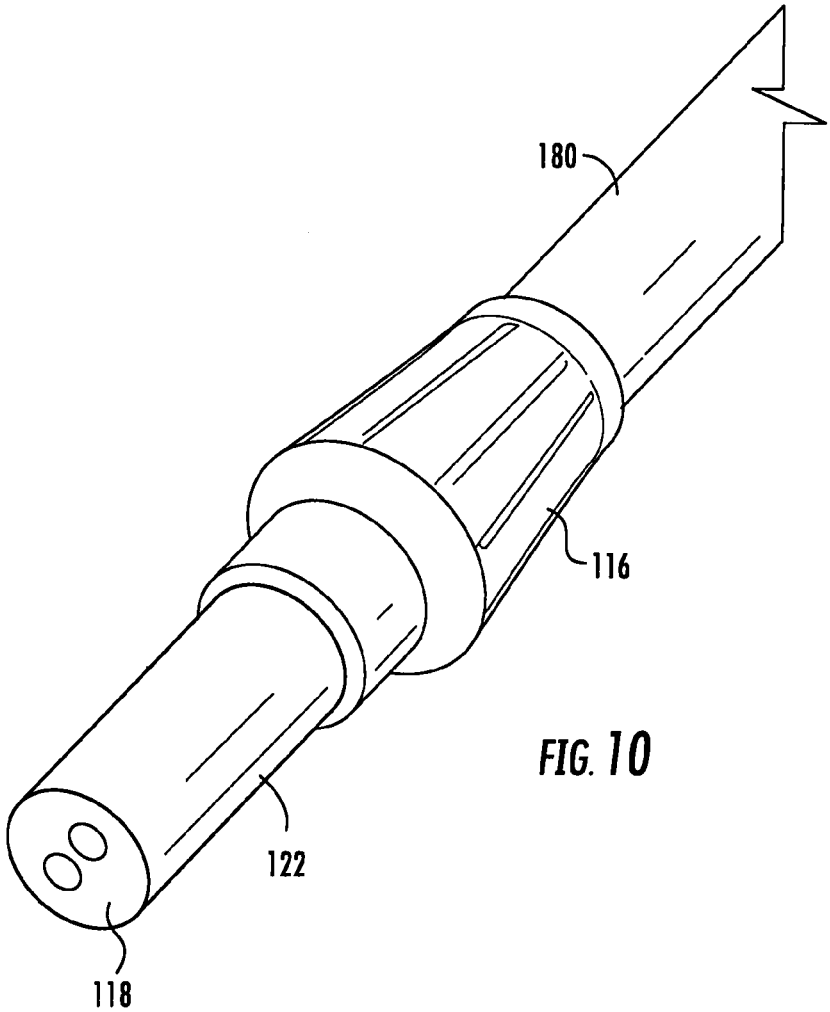
FIG. 10 is a front perspective view of the vertical support rod, showing the end which will be placed within the exposed (by removal of the anchor light) cylindrical receptacle.

FIGS. 10 and 11 show close up views of different portions of the first section of pipe which connects between the drive section on one side and either the center or driven section of pipe on the other. The first section preferably comprises a vertical pipe support which is capable of being received within the anchor light receptacle present on many small or medium size boats. The support, preferably, comprises a longitudinal sliding, until secured, holder for the pipe segment of the first section. This allows weight and length adjustment of the rods (and the motor and propeller) about the vertical support post. Also, the vertical support of the first section allows the connected pipe segments to rotate about the vertical axis defined by the vertical pipe support as it is held within the anchor light receptacle and also allows the pipe segments to tilt upwardly and downwardly (like a see saw about the fulcrum which is the vertical support post) to allow the motor and the propeller to be adjusted into and above the water. Also, as mentioned, the vertical support post preferably allows the relative sliding of the first section tube/pipe or rod segment so that more or less length of tubing, whether drive segment or driven segment, is aft or astern of the vertical pipe support. This, too, aids in adjustment and control of the device. The ball and socket joint/coupling and the clamp block facilitate this adjustment and hold the same, too.

Located on the driven section of pipe is the propeller, attached to the distal end of the flexible or solid rotatable shaft of the device. Rotation of the motor shaft causes the flexible or solid shaft to rotate and that, in turn, causes the propeller to rotate. When suitable located in water, this will cause the boat to be propelled.

The invention is ordinarily stored in its collapsed or disassembled configuration with the three (or four or five) tube/pipe or rod segments, no more than about three feet in individual length, adjacent to i.e., parallel to one another in a small length bundle. The propeller and the motor are secured to the driven and drive sections, however, and they extend laterally outwardly and yet the overall cross section and length of the device represents a small configuration. When an emergency condition is sensed, the device can be deployed. The vertical post of the drive section is slid into and held by the anchor light cylindrical receptacle. The distal end of the drive section of the tube/pipe or rod is screwed, pushed or otherwise secured to the proximal end of the first section of pipe. The proximal end of the driven section, with the propeller, is screwed, pushed, rotated, or secured to the distal end of the first section, or to the center section if needed to elongate the present invention to reach the water. The thumb screws can be hand tightened to secure the pipe of the first section appropriately which, preferably, allows for some rotational movement and slide of the pipe within the clamp block but it is tight enough such that it will hold the pipe in that location when the screws are tightened. Alternatively, the length of pipe extending towards the bow and towards the stern of the boat is adjusted, depending upon weight of the elements, height of the boat above water, etc. The shaft of the motor is always preferably connected to the rotatable shaft of the device and the end of the rotatable shaft is always preferably connected to the propeller. This is facilitated by use of a flexible rotation shaft, extending through the centers or bores of the pipes. Alternatively, the rotational shaft can comprise a set of shafts which rotate together by the use of Universal links which are outside of the pipes, when they are disassembled.

The motor is then connected to the battery. The motor can be activated by the controls and that will cause its drive shaft to rotate which will cause the flexible or solid drive shaft (or drive shaft segments connected together by Universal couplings) to rotate which will cause the propeller to rotate. Movement of the boat will ensue. At any time, the operator should be able to dip or raise the propeller, as needed, by raising or dropping the motor which, acting about the fulcrum provided by the vertical support post and the ball and socket joint at the first section, will cause the propeller to raise and lift in the water and to rotate about the axis passing vertically through the vertical support post. Rotation, as required, of the motor (and correspondingly the propeller) about the axis of the vertical post can also be accomplished as the ball, within the ball-shaped cavity or the socket of the clamp, while tightly secured, is intended to allow "on the fly" slight adjustment and maneuverability. According to a preferred embodiment of the invention, a spring loaded return to off safety throttle, which can be activated either with a thumb lever or a twist cap, is provided for safely operating the motor and the speed of the motor.

When finished, the device can be removed from the anchor light receptacle, the pipe segments disassembled and then the entire device collapsed and folded onto itself for re-storage for subsequent use. If the battery "dies" it can be replaced. If the battery is a rechargeable type, it can be selectively disconnected from the motor and recharged at a suitable source of electric power.

Torque from the small motor is transmitted from its output shaft to either the flexible or solid rotation shaft or to a rubber-like connecting sleeve (between shaft of motor and rotational shaft of the device) and then to another connecting sleeve serving to connect and transmit the torque from rotation shaft to the shaft supporting the propeller.

The present invention is collapsible, disconnectible or able to be broken down for easy storage in a boat, making it easily accessible when needed. If the motor on a boat becomes inoperable, rather than being stranded or having to wait for another boat to come along and usually preferable to swimming ashore, the present invention will provide a mechanism to make it to shore without delay. Preferably the battery driving the motor is of sufficient strength to drive the motor for at least a few hours.

It will be understood by those of ordinary skill in the art that various changes may be made and equivalents may be substituted for elements without departing from the scope of the invention. In addition, many modifications may be made to adapt a particular feature or material to the teachings of the invention without departing from the scope thereof. Therefore, it is intended that the invention not be limited to the particular embodiments disclosed, but that the invention will include all embodiments falling within the scope of the claims.

What is claimed:

1. An emergency drive unit for a boat capable of being quickly and compactly collapsed for storage and capable of being quickly and easily assembled for use, comprising:

a drive motor and a coupling for selectively connecting the same to a power supply for said drive motor;

a first tubular segment having two ends, said drive motor proximally secured to one end of said first tubular segment, and a first drive shaft component extending and mechanically connected to and from said motor through and within said first tubular segment;

a second tubular segment having two ends and a propeller rotatively and distally secured to one of said ends, said second tubular segment having a second drive shaft component secured through and within said second tubular segment and mechanically connected to said propeller;

said first tubular segment and said second tubular segment being selectively quickly and manually mechanically connectible by a connecting means to one another such that the combined length of said tubular segments when connected together is greater than the length of said individual tubular segments when not connected and such that when connected by said connection means the torque provided by said motor, when connected to and provided with power from said power supply, is transmitted to said first drive shaft component and then to said second drive shaft component to thereby rotate said propeller; and a mechanical mounting mechanism held on one of said tubular segments to hold the same to a wall of a boat.

2. An emergency drive unit for a boat as claimed in claim 1 wherein said tubular segments are secured to one another by any one of the following: screw threads; bayonet coupling; or spring-biased balls and detentes. when connected by said connection means the torque provided by said motor, when connected to and provided with power from said power supply, is transmitted to said first drive shaft component and then to said second drive shaft component to thereby rotate said propeller; and a mechanical mounting mechanism held on one of said tubular segments to hold the same to a wall of a boat.

3. An emergency drive unit for a boat as claimed in claim 1, wherein one or more additional tubular segments are connected between said first and said second tubular segments, said additional tubular segments also comprising additional drive shaft components which couple between and to said first and said second drive shaft components.

4. An emergency drive unit for a boat as claimed in claim 1, wherein said drive shaft components are flexible shafts contained within said first and said second tubular segments.

5. An emergency drive unit for a boat as claimed in claim 3, wherein all of said drive shaft components are flexible shafts contained within said first and said second tubular segments and said one or more additional tubular segments.

6. An emergency drive unit for a boat as claimed in claim 1, wherein said first drive shaft component is provided with a universal coupling for engagement with a mating universal coupling of said second drive shaft component.

7. An emergency drive unit for a boat as claimed in claim 1, wherein said connection means of said first and said second drive shaft components is comprised of an engaging female and male fitting.

8. An emergency drive unit for a boat as claimed in claim 3 wherein said mechanical connecting means for all of said tubular segments to adjacent tubular segments comprise female and male fittings for said first, second and additional drive shaft components.

9. An emergency drive unit for a boat as claimed in claim 1 wherein said tubular segments, when connected, provide a water tight compartment for said first and second drive shaft components.

10. An emergency drive unit for a boat as claimed in claim 1 wherein said mechanical mounting mechanism is adapted in shape and size to be slid into a vacant anchor light housing at the gunwale of a boat.

11. An emergency drive unit for a boat as claimed in claim 3 wherein all of said tubular segments are secured to one another by any one of the following: mating internal and external screw threads; bayonet coupling; or spring-biased balls and détentes.

12. An emergency drive unit for a boat as claimed in claim 11 wherein said first, second and additional drive shaft components are connected by female and male mechanical couplings.

* * * * *